US011161584B2

(12) United States Patent
Ikegaya et al.

(10) Patent No.: US 11,161,584 B2
(45) Date of Patent: Nov. 2, 2021

(54) OUTBOARD MOTOR

(71) Applicant: YAMAHA HATSUDOKI KABUSHIKI KAISHA, Iwata (JP)

(72) Inventors: Yuki Ikegaya, Shizuoka (JP); Takahiro Oguma, Shizuoka (JP); Satoru Hamada, Shizuoka (JP); Akihiro Onoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/918,004

(22) Filed: Jul. 1, 2020

(65) Prior Publication Data

US 2021/0001969 A1 Jan. 7, 2021

(30) Foreign Application Priority Data

Jul. 5, 2019 (JP) ..... JP2019-126056

(51) Int. Cl.

| | |
|---|---|
| ***B63H 20/20*** | (2006.01) |
| ***B63H 20/28*** | (2006.01) |
| ***B63H 23/34*** | (2006.01) |
| *B63H 20/00* | (2006.01) |

(52) U.S. Cl.

CPC ..... *B63H 20/20* (2013.01); *B63H 20/28* (2013.01); *B63H 23/34* (2013.01); *B63H 2020/006* (2013.01)

(58) Field of Classification Search

CPC .. B63H 20/20; B63H 20/28; B63H 2020/006; B63H 23/34

See application file for complete search history.

(56) References Cited

U.S. PATENT DOCUMENTS

2004/0216555 A1* 11/2004 Ide ..... B63H 20/32 74/606 R
2011/0294379 A1 12/2011 Ishizaka et al.
2015/0367925 A1* 12/2015 Oguma ..... B63H 20/20 440/88 P
2016/0185432 A1 6/2016 Achiwa et al.

FOREIGN PATENT DOCUMENTS

JP 2007-008329 A 1/2007
JP 2011-245936 A 12/2011

OTHER PUBLICATIONS

Official Communication issued in corresponding Euroepan Patent Application No. 20183578.2, dated Dec. 3, 2020.

* cited by examiner

*Primary Examiner* — Stephen P Avila
(74) *Attorney, Agent, or Firm* — Keating and Bennett, LLP

(57) ABSTRACT

An engine includes a crankshaft extending in a vertical direction. A drive shaft is connected to the crankshaft and coaxial with the crankshaft. A water intake passage is connected to the engine. A water pump is connected to the water intake passage. The water pump includes a pump shaft. The pump shaft is eccentrically mounted with respect to the drive shaft and parallel or substantially parallel to the drive shaft. The pump shaft rotates according to rotation of the drive shaft.

21 Claims, 10 Drawing Sheets

OUTBOARD MOTOR

CROSS REFERENCE TO RELATED APPLICATIONS

This application claims the benefit of priority to Japanese Patent Application No. 2019-126056 filed on Jul. 5, 2019. The entire contents of this application are hereby incorporated herein by reference.

BACKGROUND OF THE INVENTION

1. Field of the Invention

The present invention relates to an outboard motor.

2. Description of the Related Art

An outboard motor includes a water intake passage and a water pump for supplying cooling water to the engine. The water pump is driven by the rotation of the drive shaft to discharge water to the water intake passage. Conventionally, as disclosed in Japan Patent Laid-open Patent Publication JP-A-2011-245936, the water pump is arranged on the drive shaft.

The drive shaft is connected to a clutch or another element such as a shifter. Therefore, in a structure in which the water pump is arranged on the drive shaft, the water pump is arranged so as to avoid other elements in a vertical direction of the outboard motor. As a result, the outboard motor becomes large in the vertical direction.

SUMMARY OF THE INVENTION

Preferred embodiments of the present invention reduce vertical dimensions of outboard motors.

According to a preferred embodiment of the present disclosure, an outboard motor includes an engine, a drive shaft, a water intake passage, and a water pump. The engine includes a crankshaft extending in a vertical direction of the outboard motor. The drive shaft is connected to the crankshaft and coaxial with the crankshaft. The water intake passage is connected to the engine. The water pump is connected to the water intake passage. The water pump includes a pump shaft. The pump shaft is eccentrically mounted with respect to the drive shaft and parallel or substantially parallel to the drive shaft. The pump shaft is rotatable according to rotation of the drive shaft.

According to a preferred embodiment of the present disclosure, an outboard motor includes an engine, a drive shaft, a propeller shaft, a shifter, a shift shaft, a water intake passage, and a water pump. The engine includes a crankshaft extending in a vertical direction of the outboard motor. The drive shaft is connected to the crankshaft and extends in the vertical direction. The propeller shaft extends in a front-rear direction of the outboard motor. The shifter includes a shift member movable between a forward position and a reverse position. The shifter switches a direction of rotation transmitted from the drive shaft to the propeller shaft between a forward direction and a reverse direction according to a position of the shift member. The shift shaft moves the shift member between the forward position and the reverse position. The water intake passage is connected to the engine. The water pump is connected to the water intake passage. The water pump includes a pump shaft. The pump shaft is located at least partially within an outer shape of the shift shaft when viewed from an axial direction of the shift shaft, and is rotatable according to the rotation of the drive shaft.

According to a preferred embodiment of the present disclosure, an outboard motor includes an engine, a first drive shaft, a first propeller shaft, a shifter, a water intake port, a water intake passage, and a water pump. The engine includes a crankshaft. The first drive shaft is connected to the crankshaft. The first propeller shaft extends in a front-rear direction of the outboard motor. The shifter switches a direction of rotation transmitted from the first drive shaft between a forward direction and a reverse direction. Water outside the outboard motor is taken in through the water intake port. The water intake passage is connected to the engine. The water pump is connected to the water intake passage. The water pump includes a pump shaft. The pump shaft is eccentrically mounted with respect to the first drive shaft, and is rotatable according to the rotation of the first drive shaft.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
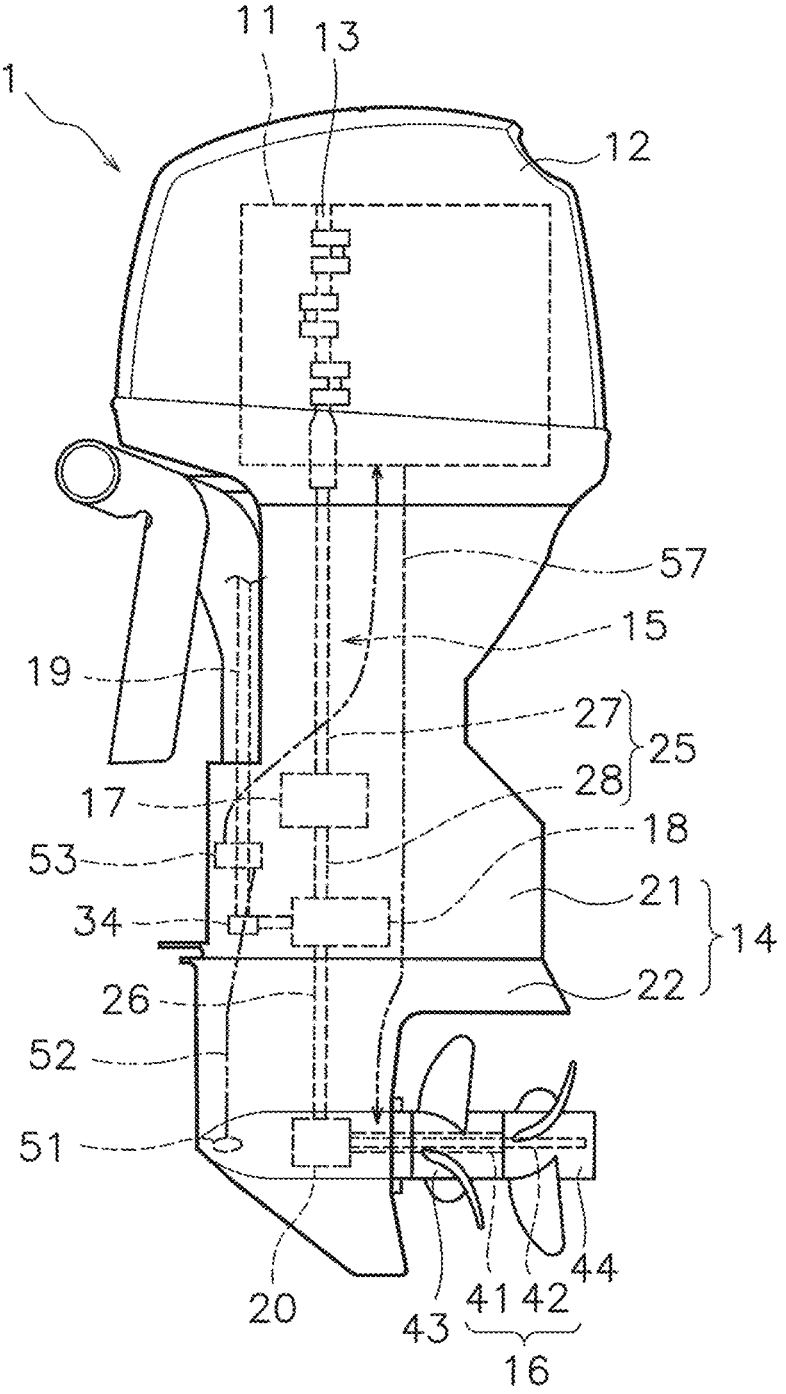
FIG. 1 is a side view of an outboard motor according to a preferred embodiment of the present invention.

Hereinafter, preferred embodiments will be described with reference to the drawings. FIG. 1 is a side view of an outboard motor 1 according to a preferred embodiment of the present invention. The outboard motor 1 is attached to a stern of a boat. As illustrated in FIG. 1, the outboard motor 1 includes an engine 11 and an engine cover 12. The engine 11 generates a propulsive force to propel the boat. The engine 11 is located in the engine cover 12. The engine 11 includes a crankshaft 13. The crankshaft 13 extends in a vertical direction of the outboard motor.

The outboard motor 1 includes a housing 14, a drive shaft 15, a propeller shaft 16, a clutch 17, a shifter 18, a shift shaft 19, and a transmission 20. The drive shaft 15, the propeller shaft 16, the clutch 17, the shifter 18, the shift shaft 19, and the transmission 20 are located in the housing 14. The housing 14 includes an upper housing 21 and a lower housing 22. The lower housing 22 is located below the upper housing 21. The drive shaft 15 is connected to the crankshaft 13. The drive shaft 15 extends in the vertical direction.

Figure 2:
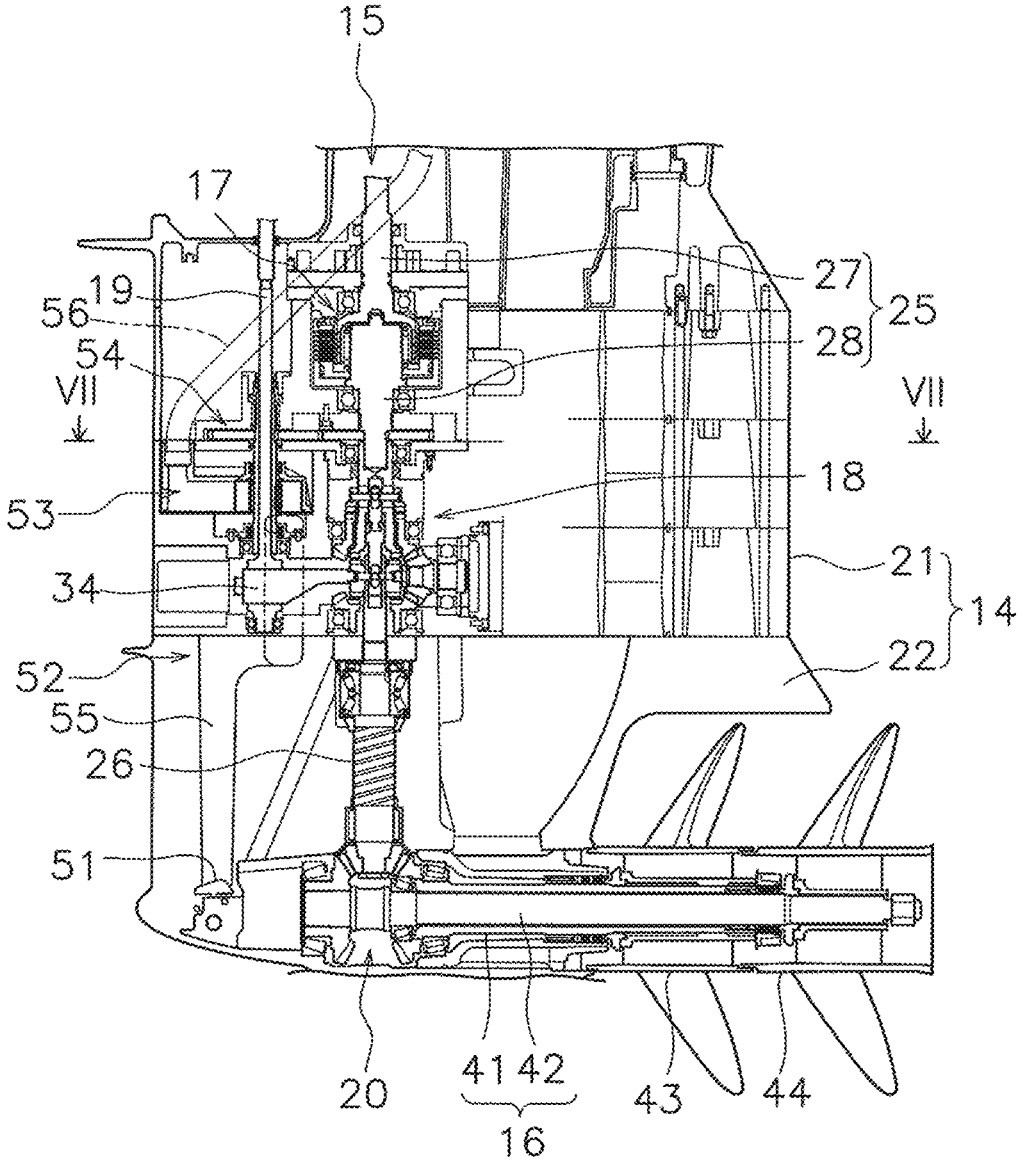
FIG. 2 is a side sectional view of a lower portion of the outboard motor.

FIG. 2 is a side sectional view showing a lower portion of the outboard motor 1. As illustrated in FIG. 2, the drive shaft 15 includes a first drive shaft 25 and a second drive shaft 26. The first drive shaft 25 is connected to the crankshaft 13. The first drive shaft 25 includes an upper shaft 27 and a lower shaft 28. The upper shaft 27 and the lower shaft 28 extend in the vertical direction. The upper shaft 27 is connected to the crankshaft 13. The lower shaft 28 is located below the upper shaft 27. The lower shaft 28 is coaxial with the upper shaft 27. The lower shaft 28 is connected to the upper shaft 27 via the clutch 17.

The clutch 17 is located between the upper shaft 27 and the lower shaft 28. The clutch 17 is switched between a connected state and a disconnected state. When the clutch 17 is in the connected state, the lower shaft 28 is connected to the upper shaft 27. When the clutch 17 is in the disconnected state, the lower shaft 28 is released from the upper shaft 27. For example, the clutch 17 includes a plurality of clutch disks. When the plurality of clutch disks come into contact with each other, the clutch 17 is brought into the connected state. When the plurality of clutch disks are separated from each other, the clutch 17 is brought into the disconnected state.

The second drive shaft 26 is located below the first drive shaft 25. The second drive shaft 26 is coaxial with the first drive shaft 25. The second drive shaft 26 is connected to the first drive shaft 25 via the shifter 18. Specifically, the second drive shaft 26 is connected to the lower shaft 28 of the first drive shaft 25 via the shifter 18.

Figure 3:
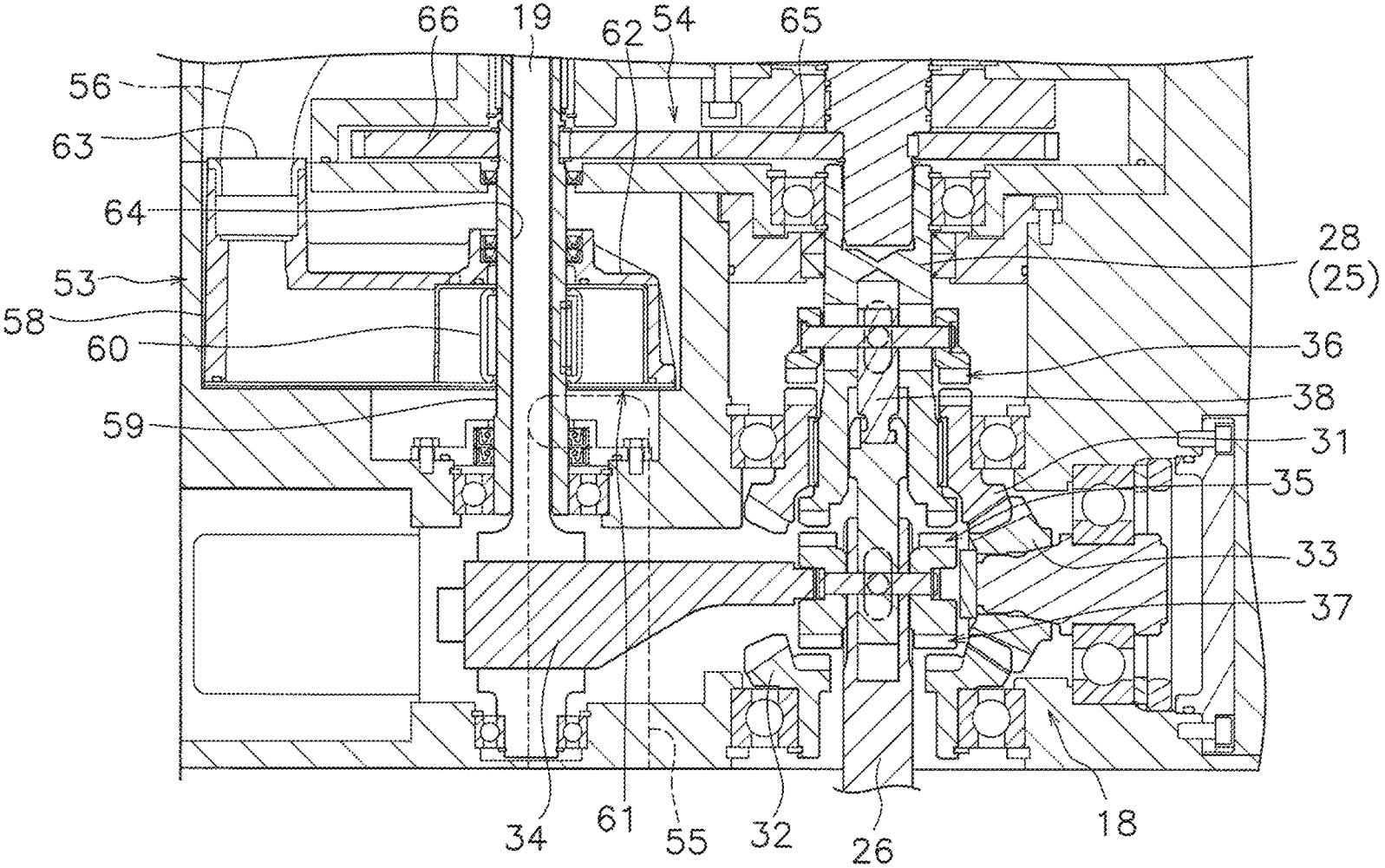
FIG. 3 is a side sectional view of a shifter and its circumference.
Figure 4:
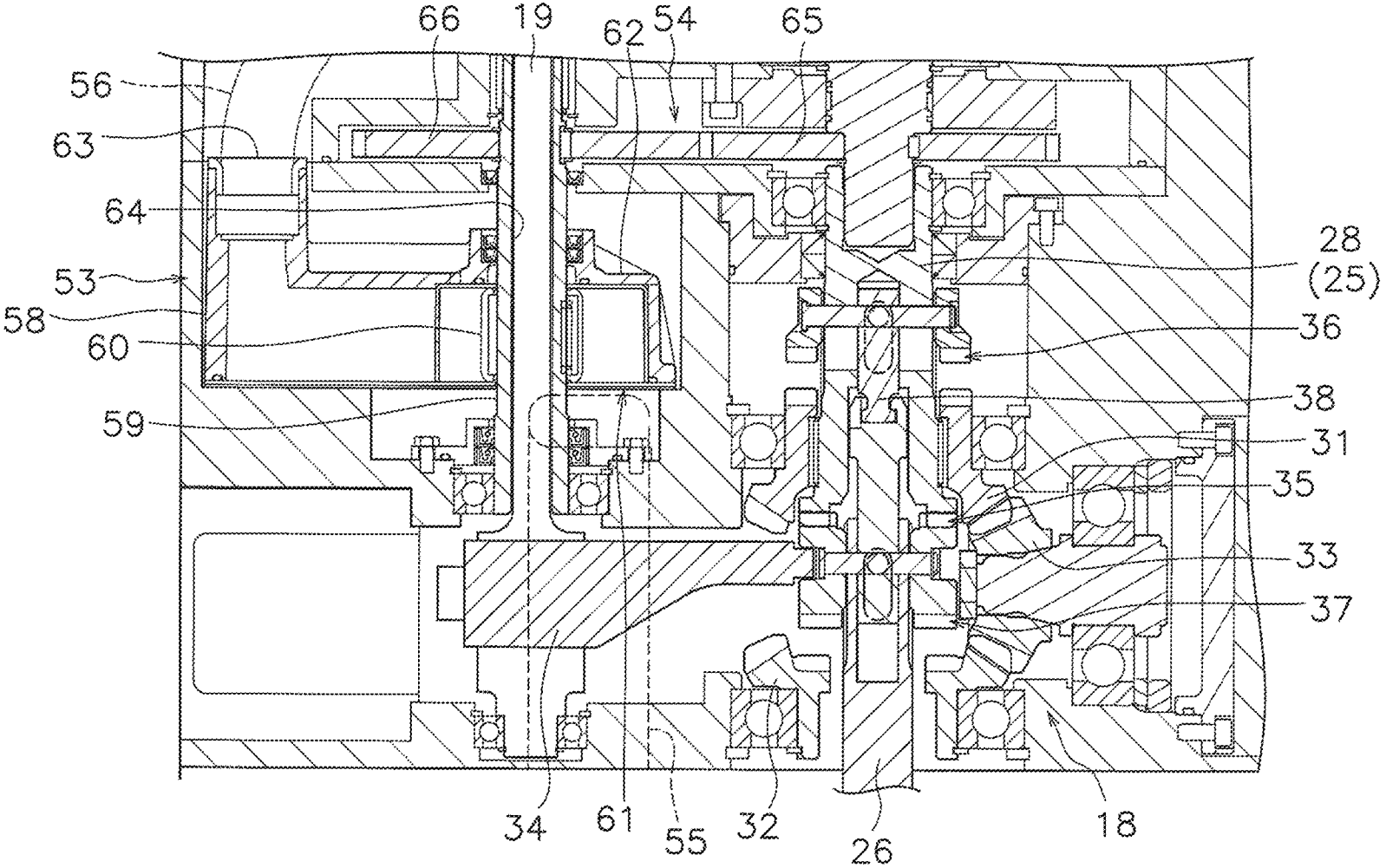
FIG. 4 is a side sectional view of the shifter and its circumference.
Figure 5:
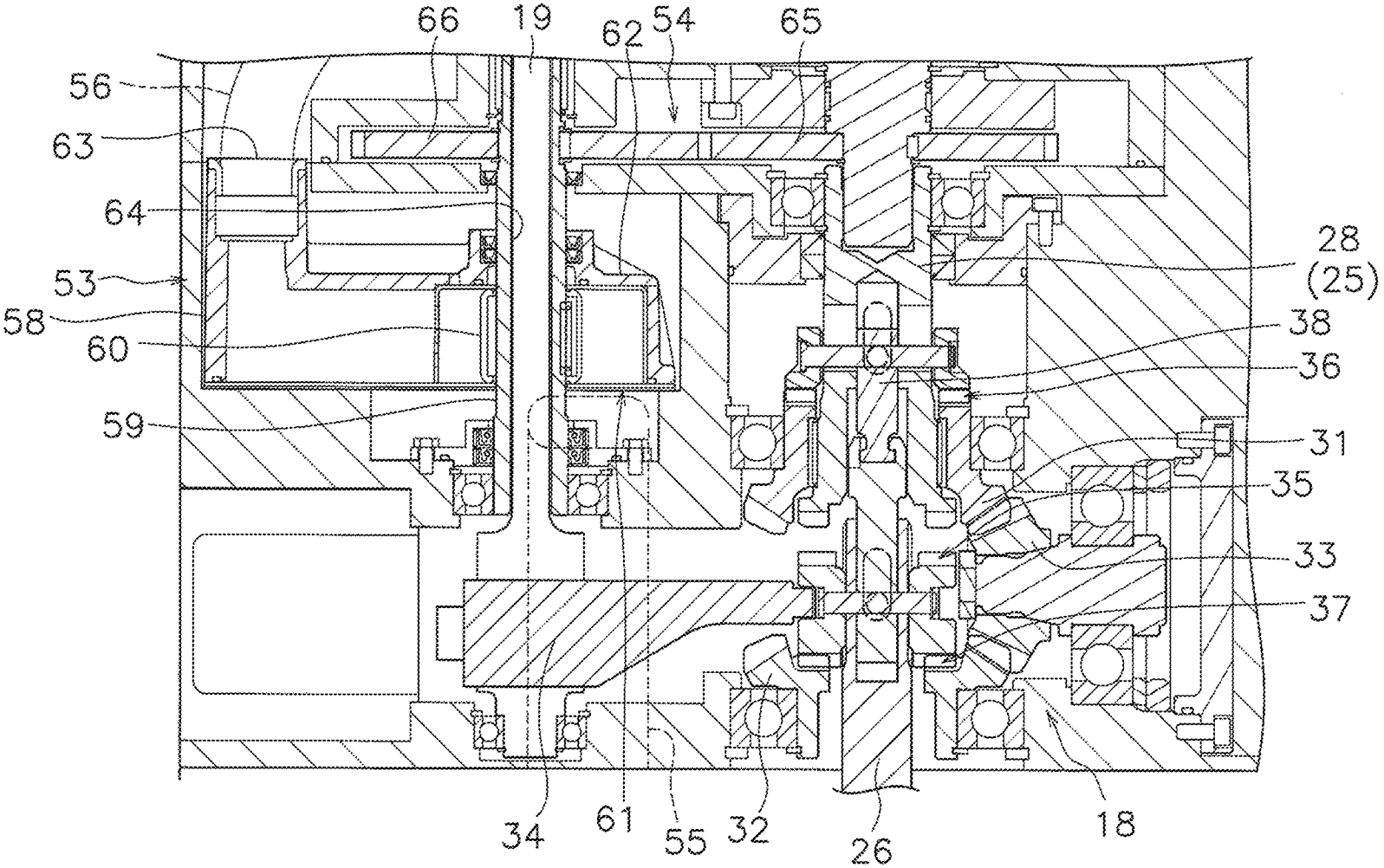
FIG. 5 is a side sectional view of the shifter and its circumference.

The shifter 18 is located between the first drive shaft 25 and the second drive shaft 26. The shifter 18 is located in the upper housing 21. The shifter 18 switches the direction of rotation transmitted from the first drive shaft 25 to the second drive shaft 26 between a forward direction and a reverse direction. FIGS. 3 to 5 are enlarged side views of the shifter 18 and its surroundings. As illustrated in FIG. 3, the shifter 18 includes a first gear 31, a second gear 32, a third gear 33, a shift member 34, a first clutch 35, a second clutch 36, and a third clutch. 37.

The first gear 31 is coaxial with the first drive shaft 25. The first gear 31 is rotatable relative to the first drive shaft 25. The second gear 32 is coaxial with the second drive shaft 26. The second gear 32 is rotatable relative to the second drive shaft 26. The third gear 33 is connected to the first gear 31 and the second gear 32. The third gear 33 reverses the rotation of the first gear 31 and transmits the rotation to the second gear 32. For example, the first to third gears 31 to 33 are bevel gears. However, the first to third gears 31 to 33 are not limited to bevel gears, but may be other types of gears. The first gear 31 meshes with the third gear 33. The third gear 33 meshes with the second gear 32.

The shift member 34 is movable in the axial direction of the second drive shaft 26. That is, the shift member 34 is movable in the vertical direction. The shift member 34 is connected to the shift shaft 19. The shift shaft 19 extends in the vertical direction. The shift shaft 19 may be connected to an actuator (not illustrated). The actuator may be, for example, an electric motor. The shift shaft 19 may be driven by an actuator according to a shift operation by an operator. Alternatively, the shift shaft 19 may be connected to a shift cable. The shift shaft 19 may be driven by the shift cable according to a shift operation by an operator.

The shift shaft 19 is located forward of the first drive shaft 25 and the second drive shaft 26. The shift shaft 19 moves the shift member 34 between a forward position, a reverse position, and a neutral position. For example, the shift shaft 19 includes a cam mechanism (not illustrated). As the shift shaft 19 rotates in one direction around the axis of the shift shaft 19, the cam mechanism raises the shift member 34. As the shift shaft 19 rotates in the other direction around the axis of the shift shaft 19, the cam mechanism lowers the shift member 34.

The first to third clutches 35 to 37 are dog clutches, for example. However, the first to third clutches 35 to 37 are not limited to dog clutches, but may be other types of clutches. The first clutch 35 is connected to the shift member 34. When the shift member 34 is in the forward position illustrated in FIG. 4, the first clutch 35 connects the second drive shaft 26 to the first drive shaft 25. When the shift member 34 is in the neutral position illustrated in FIG. 3 or the reverse position illustrated in FIG. 5, the first clutch 35 releases the second drive shaft 26 from the first drive shaft 25.

The second clutch 36 is connected to the second shift member 34 via a movable shaft 38. When the shift member 34 is in the neutral position illustrated in FIG. 3 or the forward position illustrated in FIG. 4, the second clutch 36 releases the first gear 31 from the first drive shaft 25. When the shift member 34 is in the reverse position illustrated in FIG. 5, the second clutch 36 connects the first gear 31 to the first drive shaft 25.

Figure 6:
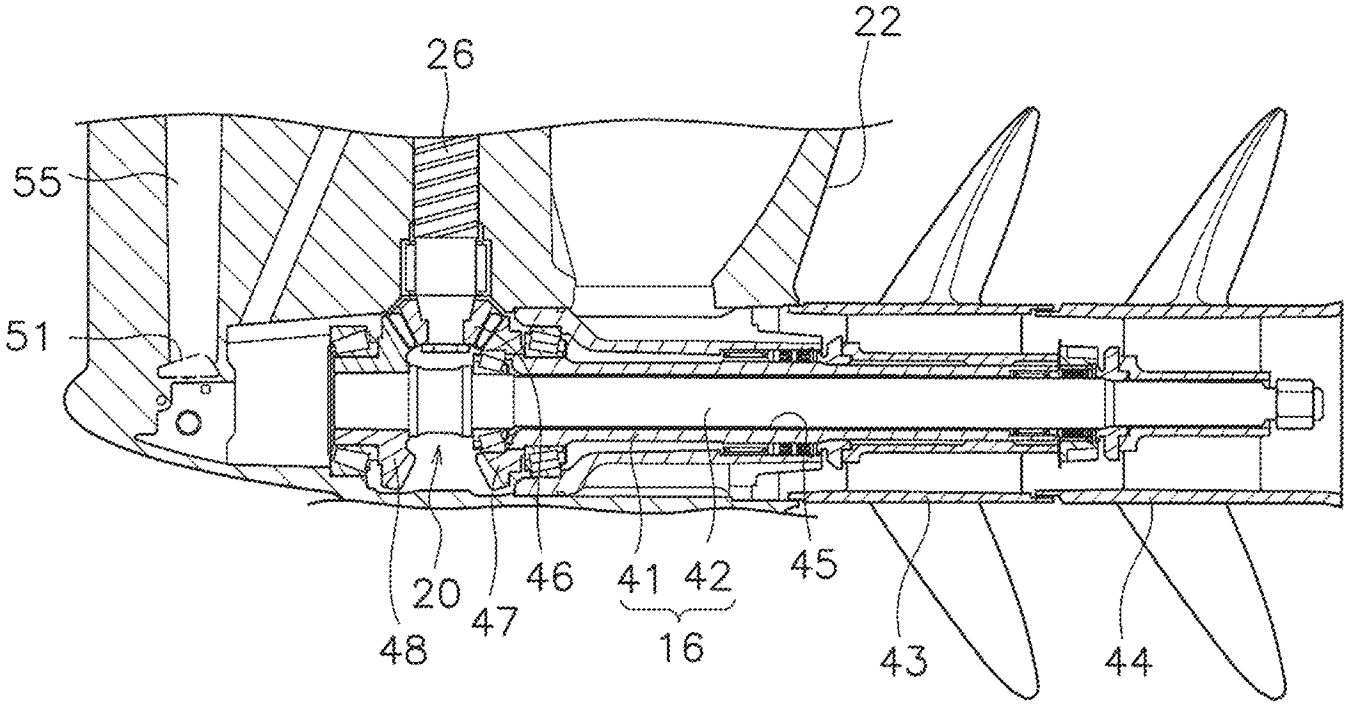
FIG. 6 is a side sectional view of a propeller shaft and a transmission.

FIG. 6 is an enlarged side view of the propeller shaft 16 and the transmission 20. The propeller shaft 16 and the transmission 20 are located in the lower housing 22. The propeller shaft 16 extends in a front-rear direction of the outboard motor 1. The propeller shaft 16 is connected to the second drive shaft 26 via the transmission 20. The propeller shaft 16 includes a first propeller shaft 41 and a second propeller shaft 42. A first propeller 43 is attached to the first propeller shaft 41. A second propeller 44 is attached to the second propeller shaft 42.

The second propeller shaft 42 is coaxial with the first propeller shaft 41. The first propeller shaft 41 includes a hole 45 extending in the front-rear direction. The hole 45 of the first propeller shaft 41 extends through the first propeller shaft 41 in the axial direction of the first propeller shaft 41. The second propeller shaft 42 is inserted into the hole 45 of the first propeller shaft 41. The second propeller shaft 42 projects forward from the first propeller shaft 41. The second propeller shaft 42 projects rearward from the first propeller shaft 41.

The transmission 20 transmits the rotation of the second drive shaft 26 to the first propeller shaft 41 and the second propeller shaft 42. The transmission 20 includes a first bevel gear 46, a second bevel gear 47, and a third bevel gear 48. The first bevel gear 46 is fixed to the second drive shaft 26. The second bevel gear 47 meshes with the first bevel gear 46. The second bevel gear 47 is fixed to the first propeller shaft 41. The third bevel gear 48 meshes with the first bevel gear 46. The third bevel gear 48 is fixed to the second propeller shaft 42. The third bevel gear 48 transmits the rotation of the first bevel gear 46 to the second propeller shaft 42 in a direction opposite to the direction of the first propeller shaft 41. Therefore, the first propeller shaft 41 and the second propeller shaft 42 rotate in directions opposite to each other. The fins of the second propeller 44 are twisted in a direction opposite to the fins of the first propeller 43. Therefore, when the first propeller shaft 41 and the second propeller shaft 42 rotate in directions opposite to each other, the first propeller shaft 41 and the second propeller shaft 42 generate a propulsive force in the same direction.

As illustrated in FIG. 2, the outboard motor 1 includes a water intake port 51, a water intake passage 52, a water pump 53, and a gearing 54. The water intake port 51 is located in the lower housing 22. Water outside the outboard motor 1 is taken into the lower housing 22 through the water intake port 51. The water intake passage 52 is located in the housing 14. The water intake passage 52 connects the engine 11 and the water intake port 51. The water intake passage 52 is connected to a cooling water passage in the engine 11. As illustrated in FIG. 1, the outboard motor 1 includes a drain passage 57. The water supplied to the cooling water passage in the engine 11 is discharged to the outside of the outboard motor 1 through the drain passage 57.

As illustrated in FIG. 2, the water intake passage 52 includes a first passage 55 and a second passage 56. The first passage 55 connects the water intake port 51 and the water pump 53. The first passage 55 is located in the lower housing 22 and the upper housing 21. The second passage 56 connects the water pump 53 and the engine 11. The second passage 56 is located in the upper housing 21.

The water pump 53 discharges water from the first passage 55 to the second passage 56. The water pump 53 is located in the upper housing 21. The water pump 53 is located forward of the first drive shaft 25 and the second drive shaft 26. At least a portion of the water pump 53 is located at the same height as the shifter 18. The water pump 53 is located forward of the shifter 18. The water pump 53 is located below the clutch 17.

As illustrated in FIG. 3, the water pump 53 includes a pump case 58, a pump shaft 59, and an impeller 60. The pump case 58 includes a suction port 61, a main body case 62, and a discharge port 63. The water intake port 51 is provided at the bottom of the pump case 58. The water pump 53 sucks water through the water intake port 51. The water intake port 51 is connected to the first passage 55. The discharge port 63 is provided on an upper portion of the pump case 58. The water pump 53 discharges water from the discharge port 63. The discharge port 63 is connected to the second passage 56.

Figure 7:
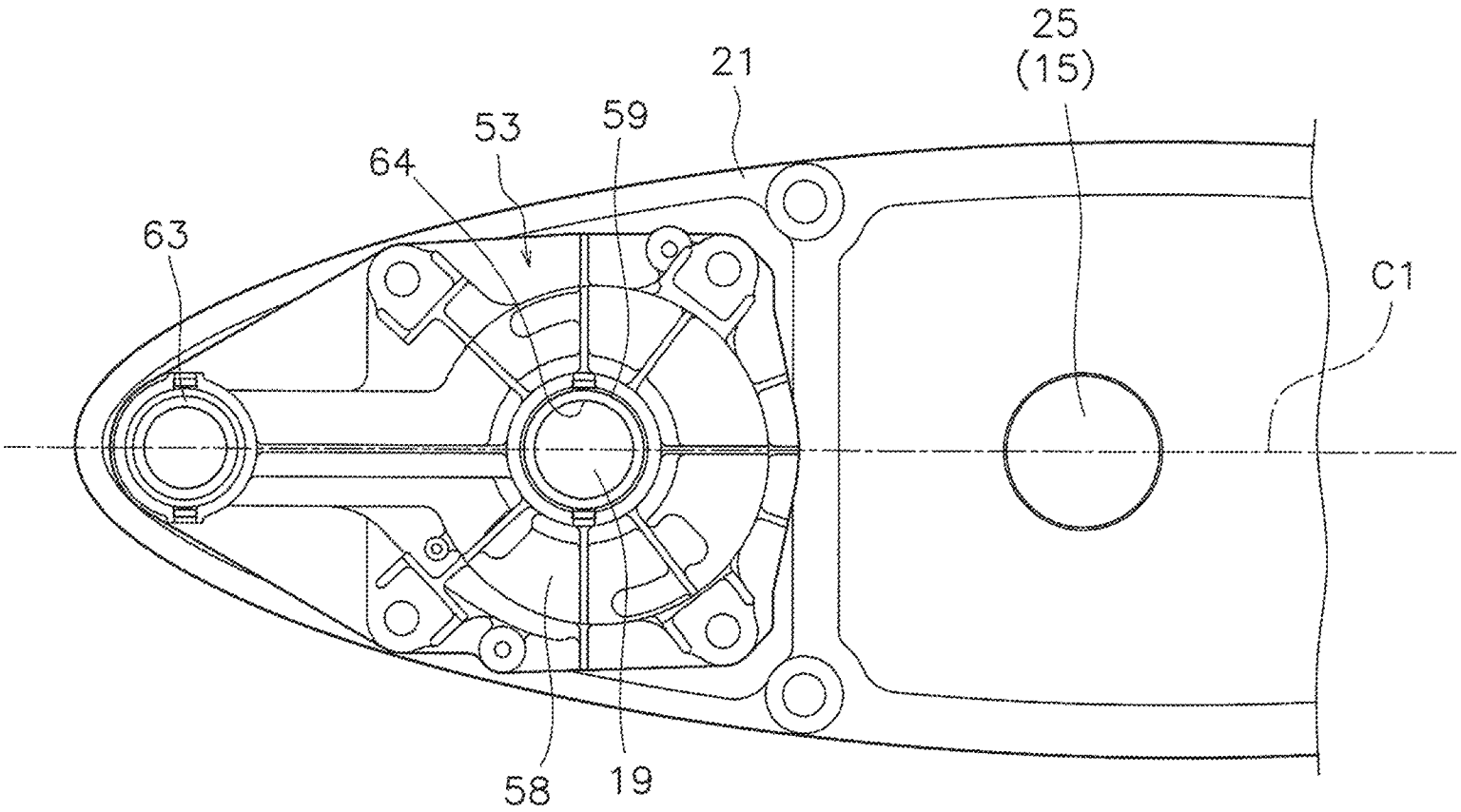
FIG. 7 is a sectional view taken along line VII-VII in FIG. 2.

The pump shaft 59 extends in the vertical direction. FIG. 7 is a sectional view taken along the line VII-VII in FIG. 2. As illustrated in FIGS. 3 and 7, the pump shaft 59 is eccentrically mounted with respect to the drive shaft 15 and parallel or substantially parallel to the drive shaft 15, i.e., the pump shaft 59 is spaced apart or offset from the drive shaft 15 in the horizontal direction. The pump shaft 59 is located forward of the first drive shaft 25. In a plan view of the outboard motor 1, the pump shaft 59 and the drive shaft 15 are located on a center line C1 of the outboard motor 1 extending in the front-rear direction.

The shift shaft 19 passes through the water pump 53. The pump shaft 59 is coaxial with the shift shaft 19. Specifically, the pump shaft 59 has a pipe shape. The pump shaft 59 includes a hole 64 extending in the axial direction of the shift shaft 19. The shift shaft 19 is inserted into the hole 64 of the pump shaft 59.

The discharge port 63 is located forward of the shift shaft 19. Therefore, the water intake passage 52 is connected to the water pump 53 at a position forward of the shift shaft 19. In a plan view of the outboard motor 1, the discharge port 63 is located on the center line C1 of the outboard motor 1. The impeller 60 is located in the main body case 62. The impeller 60 is fixed to the pump shaft 59. The impeller 60 rotates according to the rotation of the pump shaft 59. Thus, water is sucked into the pump case 58 through the suction port 61 and is discharged from the discharge port 63. The water discharged from the discharge port 63 is supplied to the engine 11 through the second passage 56.

The gearing 54 is connected to the first drive shaft 25 and the pump shaft 59. The gearing 54 transmits the rotation of the first drive shaft 25 to the pump shaft 59. The gearing 54 is located above the shifter 18. The gearing 54 is located below the clutch 17.

As illustrated in FIG. 3, the gearing 54 includes a first pump gear 65 and a second pump gear 66. The first pump gear 65 is fixed to the first drive shaft 25. The first pump gear 65 and the second pump gear 66 are, for example, spur gears. However, the first pump gear 65 and the second pump gear 66 are not limited to spur gears, and may be other types of gears. The first pump gear 65 is located above the shifter 18. The first pump gear 65 is located below the clutch 17.

The second pump gear 66 is fixed to the pump shaft 59. The second pump gear 66 is located above the main body case 62. The second pump gear 66 meshes with the first pump gear 65. The rotation of the first drive shaft 25 is transmitted to the pump shaft 59 via the first pump gear 65 and the second pump gear 66. Thus, the pump shaft 59 rotates according to the rotation of the drive shaft 15.

In the outboard motor 1 according to the preferred embodiments described above, the pump shaft 59 is eccentrically mounted with respect to the drive shaft 15. Therefore, the water pump 53 is able to be located at a lower position than the structure in which the water pump 53 is located on the drive shaft 15. Thus, the outboard motor 1 is able to be downsized in the vertical direction. Further, by disposing the water pump 53 at a lower position, the distance between the water intake port 51 and the water pump 53 is reduced. Thus, a decrease in the water absorption capacity of the water pump 53 is significantly reduced.

In the outboard motor 1 according to the preferred embodiments described above, the pump shaft 59 is coaxial with the shift shaft 19. Therefore, the water pump 53 is able to be located at a lower position than the structure in which the water pump 53 is located on the drive shaft 15. This makes it possible to reduce the size of the outboard motor 1 in the vertical direction while significantly decreasing the water absorption capacity of the water pump 53. Further, the outboard motor 1 is able to be reduced in size as compared with a structure in which the water pump 53 is located so as to avoid the shift shaft 19.

Figure 8:
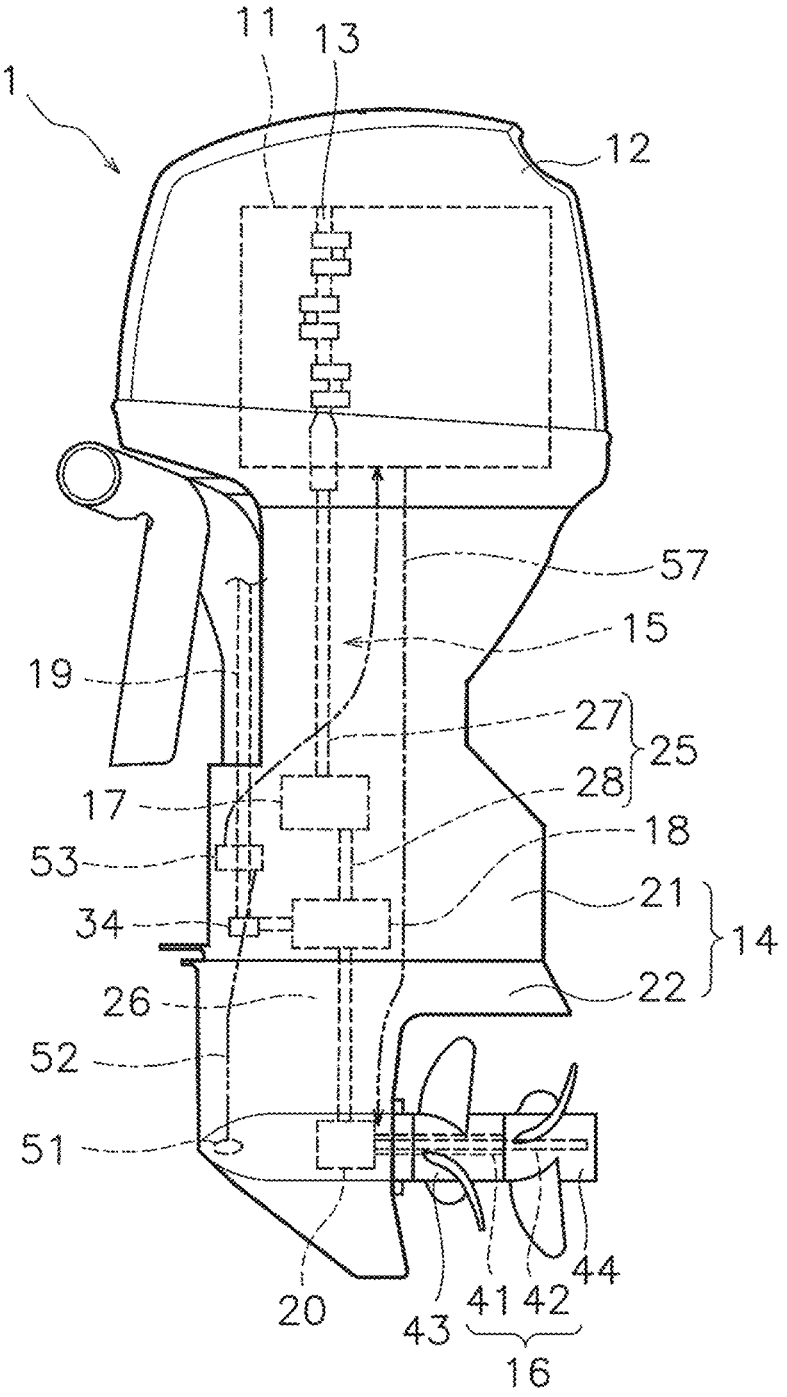
FIG. 8 is a side view of the outboard motor according to a first modified preferred embodiment of the present invention.

In the above-described preferred embodiments, the drive shaft 15 is coaxial with the crankshaft 13. However, the drive shaft 15 does not have to be coaxial with the crankshaft 13. For example, as illustrated in FIG. 8, the second drive shaft 26 may be eccentrically mounted with respect to the crankshaft 13 and the first drive shaft 25.

Figure 9:
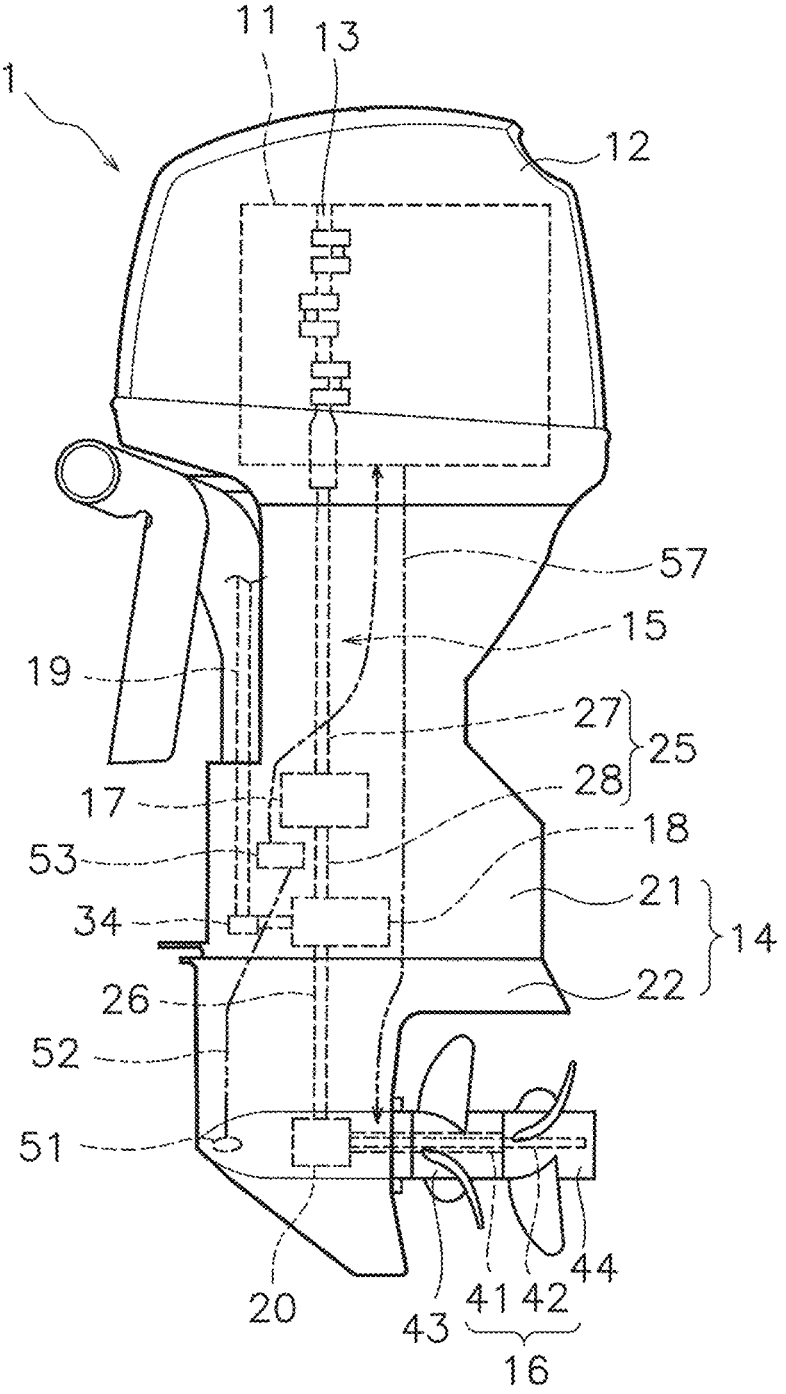
FIG. 9 is a side view of the outboard motor according to a second modified preferred embodiment of the present invention.

In the above-described preferred embodiments, the pump shaft 59 is coaxial with the shift shaft 19. However, the pump shaft 59 may be eccentrically mounted with respect to the shift shaft 19. For example, the pump shaft 59 may be eccentrically mounted with respect to the shift shaft 19 in the front-rear direction. Alternatively, the pump shaft 59 may be eccentrically mounted with respect to the shift shaft 19 in the left-right direction of the outboard motor 1. As illustrated in FIG. 9, the water pump 53 may be located rearward of the shift shaft 19. Alternatively, the water pump 53 may be located on the lateral side of the shift shaft 19.

Figure 10:
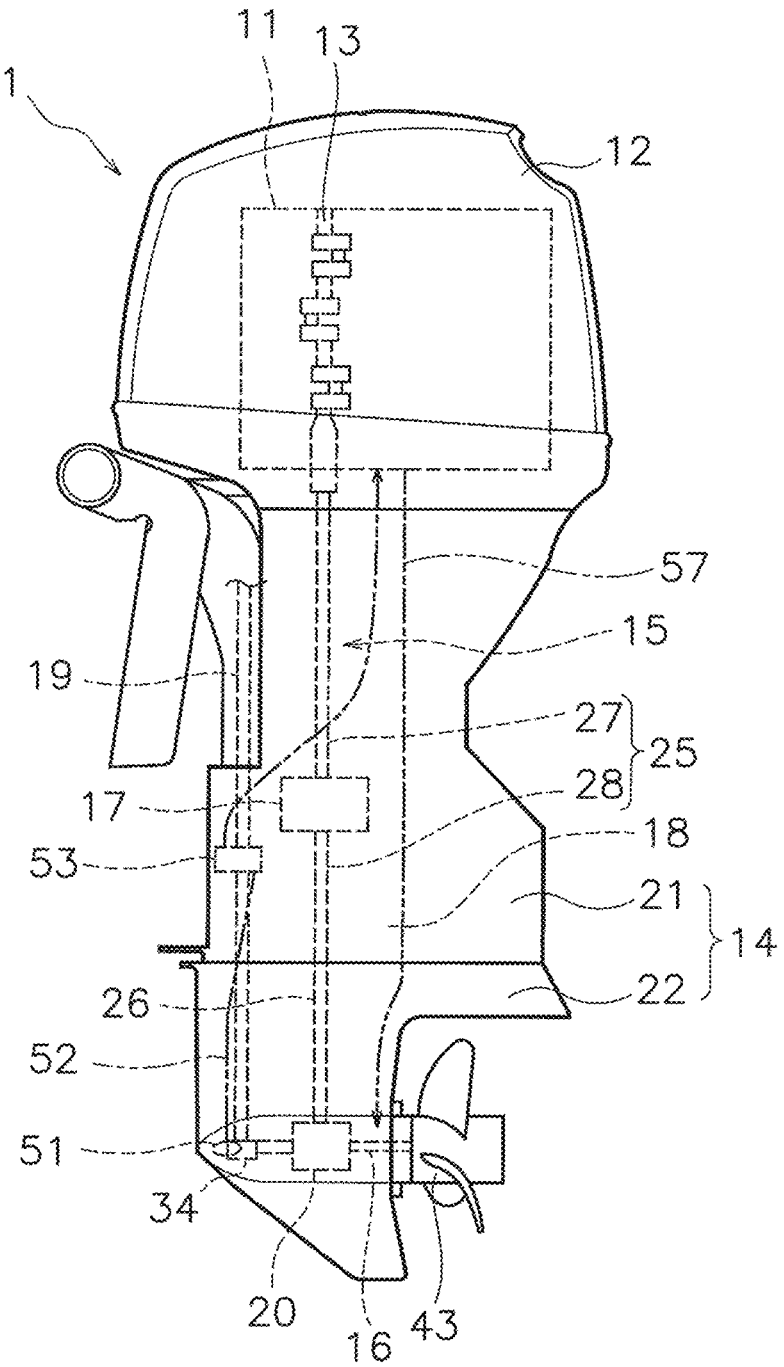
FIG. 10 is a side view of the outboard motor according to a third modified preferred embodiment of the present invention.

In the above-described preferred embodiments, the outboard motor 1 includes two propellers. However, as illustrated in FIG. 10, the outboard motor 1 may include only one propeller. The structure of the shifter 18 is not limited to the above-described preferred embodiments, and may be changed. The structure of the water pump 53 is not limited to the above-described preferred embodiments, and may be changed. The water pump 53 may be located in the lower housing 22, and not limited to the upper housing 21. The structure of the gearing 54 is not limited to that of the above-described preferred embodiments, and may be changed. The gearing 54 may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a crankshaft extending in a vertical direction of the outboard motor;

a drive shaft connected to the crankshaft and coaxial with the crankshaft;

a water intake passage connected to the engine; and a water pump connected to the water intake passage and including a pump shaft eccentrically mounted with respect to the drive shaft and parallel or substantially parallel to the drive shaft; wherein the pump shaft is rotatable according to rotation of the drive shaft.

2. The outboard motor according to claim 1, wherein the pump shaft is located forward of the drive shaft.

3. The outboard motor according to claim 1, further comprising:

a gearing connected to the drive shaft to transmit the rotation of the drive shaft to the pump shaft.

4. The outboard motor according to claim 3, further comprising:

a propeller shaft extending in a front-rear direction of the outboard motor; and a shifter including a shift member movable between a forward position and a reverse position, the shifter being able to switch a direction of rotation transmitted from the drive shaft to the propeller shaft between a forward direction and a reverse direction according to a position of the shift member; wherein the gearing is connected to the drive shaft at a located above the shifter.

5. The outboard motor according to claim 1, further comprising:

a propeller shaft extending in a front-rear direction of the outboard motor;

a shifter including a shift member movable between a forward position and a reverse position, the shifter being able to switch a direction of rotation transmitted from the drive shaft to the propeller shaft between a forward direction and a reverse direction according to a position of the shift member; and a shift shaft extending in the vertical direction to move the shift member between the forward position and the reverse position; wherein the shift shaft extends through the water pump.

6. The outboard motor according to claim 1, further comprising:

a propeller shaft extending in a front-rear direction of the outboard motor;

a shifter including a shift member movable between a forward position and a reverse position, the shifter being able to switch a direction of rotation transmitted from the drive shaft to the propeller shaft between a forward direction and a reverse direction according to a position of the shift member; and a shift shaft extending in the vertical direction to move the shift member between the forward position and the reverse position; wherein the pump shaft is coaxial with the shift shaft.

7. The outboard motor according to claim 6, wherein the pump shaft has a pipe shape including a hole extending in an axial direction of the shift shaft; and the shift shaft extends through the hole of the pump shaft.

8. The outboard motor according to claim 1, further comprising:

a propeller shaft extending in a front-rear direction of the outboard motor;

a shifter including a shift member movable between a forward position and a reverse position, the shifter being able to switch a direction of rotation transmitted from the drive shaft to the propeller shaft between a forward direction and a reverse direction according to a position of the shift member; and a shift shaft extending in the vertical direction to move the shift member between the forward position and the reverse position; wherein the water intake passage is connected to the water pump at a location forward of the shift shaft.

9. An outboard motor comprising:

an engine including a crankshaft extending in a vertical direction of the outboard motor;

a drive shaft connected to the crankshaft and extending in the vertical direction;

a propeller shaft extending in a front-rear direction of the outboard motor;

a shifter including a shift member movable between a forward position and a reverse position, the shifter being able to switch a direction of rotation transmitted from the drive shaft to the propeller shaft between a forward direction and a reverse direction according to a position of the shift member;

a shift shaft to move the shift member between the forward position and the reverse position;

a water intake passage connected to the engine; and a water pump connected to the water intake passage and including a pump shaft, the pump shaft being located at least partially within an outer shape of the shift shaft when viewed from an axial direction of the shift shaft; wherein the pump shaft is rotatable according to rotation of the drive shaft.

10. The outboard motor according to claim 9, wherein the shift shaft extends through the water pump.

11. The outboard motor according to claim 9, wherein the pump shaft has a pipe shape including a hole extending in the axial direction of the shift shaft; and the shift shaft extends through the hole of the pump shaft.

12. The outboard motor according to claim 9, wherein the pump shaft is located forward of the drive shaft.

13. The outboard motor according to claim 9, further comprising:

a gearing connected to the drive shaft and the pump shaft to transmit rotation of the drive shaft to the pump shaft; wherein the gearing is connected to the drive shaft at a location above the shifter.

14. An outboard motor comprising:

an engine including a crankshaft;

a first drive shaft connected to the crankshaft;

a first propeller shaft extending in a front-rear direction of the outboard motor;

a shifter able to switch a direction of rotation transmitted from the first drive shaft between a forward direction and a reverse direction;

a water intake port to take in external water;

a water intake passage connected to the engine; and a water pump connected to the water intake passage and including a pump shaft eccentrically mounted with respect to the first drive shaft and parallel or substantially parallel to the first drive shaft; wherein the pump shaft is rotatable in accordance with rotation of the first drive shaft.

15. The outboard motor according to claim 14, wherein the pump shaft is located forward of the first drive shaft.

16. The outboard motor according to claim 14, further comprising:

a gearing connected to the first drive shaft and the pump shaft to transmit rotation of the first drive shaft to the pump shaft.

17. The outboard motor according to claim 16, wherein the gearing is connected to the first drive shaft at a location above the shifter.

18. The outboard motor according to claim 14, further comprising a shift shaft; wherein the shifter includes a shift member movable between a forward position and a reverse position;

the shift shaft is able to move the shift member between the forward position and the reverse position;

the shifter switches a direction of rotation from the first drive shaft to the forward direction and the reverse direction according to a position of the shift member; and the shift shaft extends through the water pump.

19. The outboard motor according to claim 14, wherein the shifter includes a shift member movable between a forward position and a reverse position;

the outboard motor further comprises a shift shaft to move the shift member between the forward position and the reverse position;

the shifter switches a direction of rotation from the first drive shaft to the forward direction and the reverse direction according to a position of the shift member; and the pump shaft is coaxial with the shift shaft.

20. The outboard motor according to claim 19, wherein the pump shaft has a pipe shape including a hole extending in an axial direction of the shift shaft; and the shift shaft extends through the hole of the pump shaft.

21. The outboard motor according to claim 14, further comprising:

a second propeller shaft coaxial with the first propeller shaft and extending in the front-rear direction;

a second drive shaft located below the first drive shaft and extending in a vertical direction of the outboard motor; and a transmission to transmit rotation from the second drive shaft to the first propeller shaft and the second drive shaft; wherein the shifter is located between the first drive shaft and the second drive shaft to switch a direction of rotation transmitted from the first drive shaft to the second drive shaft between the forward direction and the reverse direction.

* * * * *